US005775549A

United States Patent [19]

de Laforcade

[11] Patent Number: 5,775,549

[45] Date of Patent: Jul. 7, 1998

[54] SPRAY PACKAGE AND PROCESS FOR PRODUCING THE SAME

[75] Inventor: Vincent de Laforcade, Rambouillet, France

[73] Assignee: L'Oreal, Paris, France

[21] Appl. No.: 596,925

[22] Filed: Mar. 13, 1996

[30] Foreign Application Priority Data

Mar. 15, 1995 [FR] France ..... 95 03012

[51] Int. Cl.[6] ..... B67D 5/42

[52] U.S. Cl. ..... 222/389

[58] Field of Search ..... 222/386, 389, 222/402.1, 387; 277/208

[56] References Cited

U.S. PATENT DOCUMENTS

| | | | |
|---|---|---|---|
| 112,770 | 3/1871 | Blessing | 277/208 |
| 3,273,762 | 9/1966 | O'Neill, Jr. . | |
| 3,381,863 | 5/1968 | Towns | 222/389 |
| 3,915,352 | 10/1975 | Scheindel . | |
| 5,042,696 | 8/1991 | Williams | 222/389 |
| 5,056,690 | 10/1991 | Ichihara et al. . | |

FOREIGN PATENT DOCUMENTS

| | | |
|---|---|---|
| 370458 | 2/1907 | France . |
| 3 624 638 | 2/1988 | Germany . |

*Primary Examiner*—Philippe Derakshani
*Attorney, Agent, or Firm*—Young & Thompson

[57] ABSTRACT

A package (1) in the form of a spray container in which slides a piston. There is a dispensing nozzle at one end of the container and a liquid to be dispensed between the piston and the nozzle. A compressed gas occupies the container on the other side of the piston. The seal between the piston and the internal side wall of the container is ensured by shallow annular grooves in the internal side wall, having an interval less than 1,000 μm and a depth no greater than 100 μm.

15 Claims, 1 Drawing Sheet

SPRAY PACKAGE AND PROCESS FOR PRODUCING THE SAME

BACKGROUND OF THE INVENTION

The present invention relates to packaging comprising a piston, and a process for production of this packaging. This packaging contains in particular a liquid to be sprayed by means of a propulsive gas. This package can be used in the fields of foodstuffs, chemistry, cosmetics, dermatology, insecticides or cleaning agents.

It is known to use packaging of cylindrical shape, generally called an aerosol can, comprising internally a piston capable of sliding along a greater portion of the length of the packaging, generally the longitudinal axis.

The pistons of this packaging are conventionally provided with joints matching the shape of the packaging/piston assembly, such as for example a toric joint or O-ring. These joints ensure sealing of the piston and hence of the packaging relative to the liquid and the gas present in the compartments separated by the piston. This sealing being insufficient as to the liquid (the gas can pass into the liquid), it is moreover necessary to reinforce the seal by the presence of a sealing lip mounted on the joint secured to the piston. Thus, when the piston slides along the major axis of the packaging, the combination of the sealing lip and of the joint on the piston permits, whilst scraping the internal wall of the packaging, ensuring correct sealing of the packaging as to the liquid that it contains.

Unfortunately, the combination of these two elements does not permit sufficient sealing between the gas and the liquid present in the packaging. Thus, the gas under pressure diffuses slowly and constantly toward the liquid despite the combined presence of the joint and of the sealing lip of the piston. This slow and constant diffusion of the gas is due to the presence of a multitude of score lines parallel to the longitudinal axis of the packaging; the presence of these score lines is a result of the process of drawing used during production of the packaging.

One way to overcome this sealing problem consists particularly in cladding the internal wall of the packaging with a varnish. But no matter what the physical-chemical properties of this varnish, it is impossible completely to fill in the score lines.

OBJECTS OF THE INVENTION

The invention has for its object to provide a new packaging which permits ensuring sufficient and correct sealing between the gas and the liquid present in the packaging, whilst ensuring the sealing of the piston relative to the gas, and hence overcoming the drawbacks of the prior art.

The present invention therefore has for its object a packaging having a longitudinal axis, comprising an internal wall and an external wall, in which slides a piston, wherein a portion of the internal wall adapted to come into contact with the piston comprises grooves perpendicular to the longitudinal axis to ensure sealing between the piston and the wall.

The invention more particularly has for its object a packaging of substantially cylindrical shape containing in two separate compartments a liquid and a propulsive gas.

Thus, the packaging according to the invention permits ensuring correct and sufficient sealing of the piston relative to the propulsive gas and to the liquid, without having recourse to the use of a cladding substance, such as a varnish, on the internal wall of the packaging.

Preferably, the piston of the packaging is provided with a joint which is continuous in a plane parallel to the grooves, the joint ensuring, as in the prior art, sealing of the gas relative to the liquid.

For substantially cylindrical packaging, the joint can be annular and preferably is of substantially toric shape.

The invention also has for its object a process for the production of the packaging described above.

This process comprises a step of brushing the internal wall of the packaging perpendicularly to the longitudinal axis. This step consists in introducing a brush into the packaging, applying it to the internal surface without translatory movement, then withdrawing and washing the packaging to remove particles of material from the brushing operation. The other steps of the process are according to the prior art.

The grooves present in the internal wall of the packaging can be irregularly spaced. Preferably, these grooves are continuous. They can be spaced a distance no more than 1,000 μm and preferably a distance no more than 100 μm.

These grooves can moreover have a depth no greater than 100μm, preferably 25 μm to 50 μm.

The grooves can be deeper than the crevices parallel to the longitudinal axis, produced by drawing of the internal wall. As a result, the influence of the score lines is wiped out by the presence of the grooves perpendicular to this axis.

The packaging can be produced of a material selected from rigid plastic materials and metallic materials. Preferably, the packaging is of metal and particularly aluminum, steel or iron. Generally speaking, the packaging is made of a material whose hardness is sufficient to produce the grooves during brushing of the internal wall.

The packaging can contain any composition conventionally used in the field of cosmetology and/or dermatology or foodstuffs. The propulsive gas used can be any gas conventionally used in the fields mentioned above.

BRIEF DESCRIPTION OF THE DRAWING

There will now be given, by way of illustration, an example of packaging according to the invention, referring to the figures of drawing, in which.

DETAILED DESCRIPTION OF THE INVENTION

Figure 1:
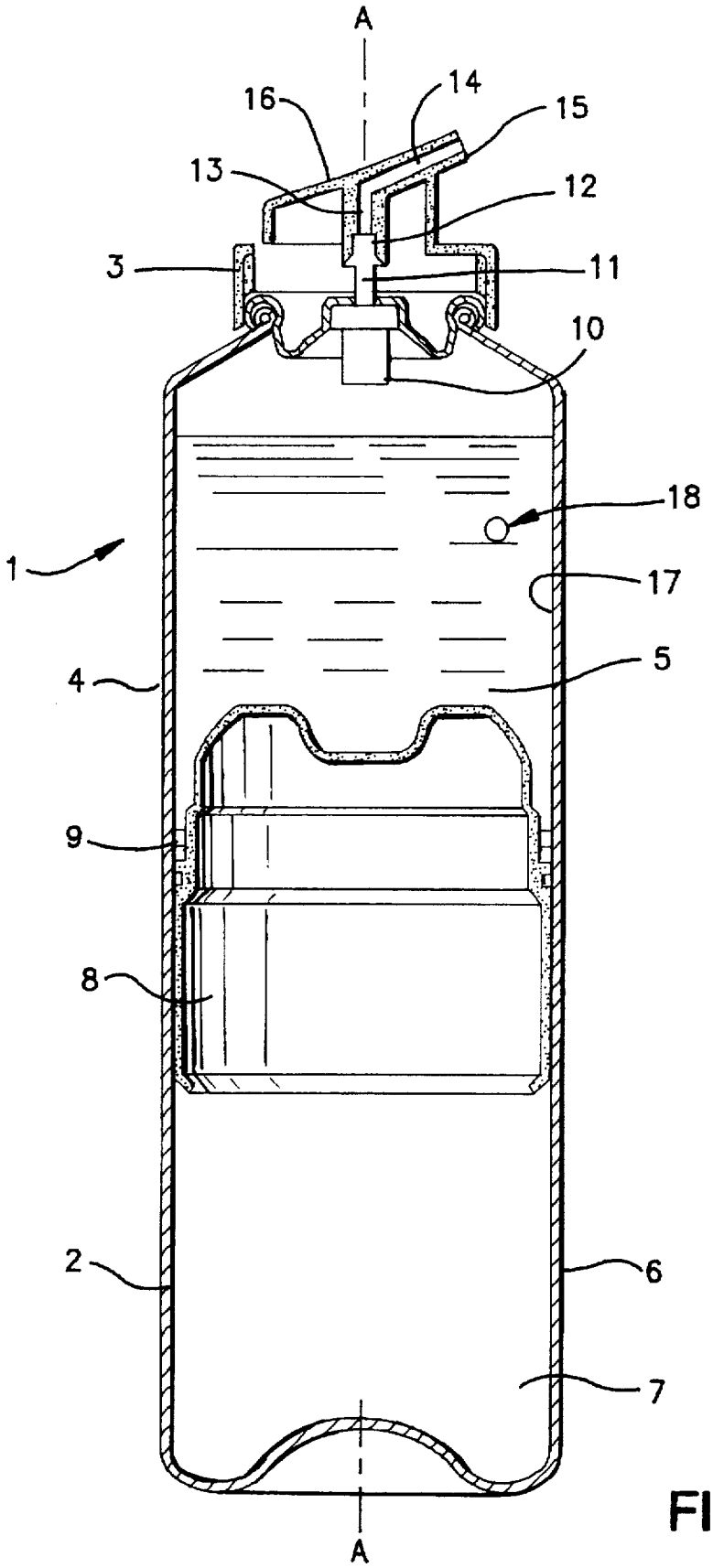
FIG. 1 is a longitudinal cross-sectional view, the longitudinal axis A; of the container lying in the plane of the drawing.

In the FIG. 1, there is shown a package 1 of cylindrical shape comprising an aluminum body 2 and a plastic cap 3.

The body 2 is constituted on the one hand by a compartment 4 containing liquid 5 and on the other hand by a compartment 6, separate from the compartment 4, and containing the propulsive gas 7. A piston 8 provided about its periphery with a toric joint 9 separates the two compartments. Preferably, the body 2 can be provided also with a filling valve (not shown) for the propulsive gas 7.

The cap 3 protects the spray assembly constituted by a valve 10 in which is inserted a control rod 11. The rod 11 comprises a shoulder 12 on which bears a fingerpiece 13 provided with an outlet.

At the outlet of the fingerpiece 13 is located a channel 14 which opens on the spray nozzle 15 for the liquid. The cap 3 moreover comprises a pushbutton 16 that the user can press on to dispense the liquid.

Figure 2:
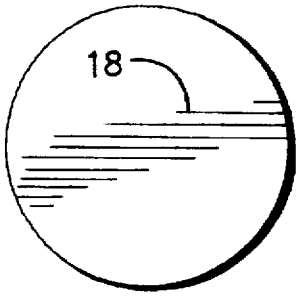
FIG. 2 is an enlarged view of the circled portion of FIG. 1.

According to the invention, the body 2 comprises on its internal wall 17 grooves 18 regularly spaced apart by 50 μm. These grooves are formed to a depth of 30 μm in the internal wall 17. These grooves are obtained by brushing the internal wall by a rotating brush with metallic bristles and are best seen in FIG. 2.

To effect spraying of the liquid, the user presses on the pushbutton 16. This permits the fingerpiece 13 to bear against the shoulder 12 of the rod 11 and hence to cause the liquid to leave through the nozzle.

The simultaneous presence of a joint 9 on the piston 8 disposed between the compartments 4 and 6, and the grooves 18 on the internal wall 17 of the body 2, permits ensuring excellent sealing between the gas and the liquid at the piston.

I claim:

1. Packaging (1) having a longitudinal axis, comprising an internal wall (17) and an external wall, and a piston (8) sliding within and in contact with the internal wall, a portion of said internal wall that is adapted to come into contact with the piston having grooves (18) with a depth no greater than 100 μm that are perpendicular to said longitudinal axis to ensure sealing between the piston and said internal wall.

2. Packaging according to claim 1, wherein the grooves (18) are annula.

3. Packaging according to claim 1, wherein the grooves are spaced apart from each other at an interval no more than 1,000 μm.

4. Packaging according to claim 1, wherein the piston (8) is provided with a sealing joint (9) which is continuous in a plane parallel to the grooves (18).

5. Packaging according to claim 1, wherein said internal wall (17) is substantially cylindrical.

6. Packaging according to claim 4, wherein the joint (9) is toric.

7. Packaging according to claim 1, which contains a liquid (5) and a gas (7) for propelling the liquid.

8. Packaging according to claim 7, in which the liquid (5) and the gas (7) are disposed on opposite sides of the piston.

9. Packaging according to claim 8 further comprising a dispensing valve (10), the liquid being located between the dispensing valve (10) and the piston (8).

10. Process for producing packaging having a longitudinal axis and comprising an internal wall (17) and an external wall and a piston (8) sliding in the packaging in contact with the internal wall (17), the process comprising brushing the internal wall (17) of the packaging in a direction perpendicular to said longitudinal axis thereby to impart to said internal wall grooves (18) perpendicular to the longitudinal axis so as to ensure sealing between said internal wall (17) and a said piston (8) and thereafter inserting said piston (8) into the packaging in contact with said internal side wall (17).

11. A packaging (1) having a longitudinal axis, comprising a cylindrical internal wall (17) and an external wall, and a piston (8) sliding in the packaging and having an annular sealing joint (9) which is in sealing contact with said internal wall; the improvement comprising annular grooves (18) perpendicular to said longitudinal axis and disposed in said internal wall to insure sealing between said sealing joint and said internal wall, said grooves being spaced apart from each other by no more than 1,000 μm and having a depth no greater than 100 μm.

12. Packaging according to claim 11, which contains a liquid (5) and a gas (7) for propelling the liquid.

13. Packaging according to claim 12, in which the liquid (5) and the gas (7) are disposed on opposite sides of the piston.

14. Packaging according to claim 13, further comprising a dispensing valve (10) for the liquid, the liquid being located between the dispensing valve (10) and the piston (8).

15. A process for producing packaging having a longitudinal axis and comprising a cylindrical inner wall (17) and an external wall and a piston (8) having an annular sealing joint (9) sliding in the packaging in contact with said internal wall (17), the process comprising brushing the internal wall (17) of the packaging in a direction perpendicular to said longitudinal axis thereby to form in said internal wall (17) annular grooves (18) perpendicular to said longitudinal axis so as to insure sealing between said internal wall (17) and said sealing joint (9), said grooves being spaced apart from each other no more than 1,000 μm and having a depth no greater than 100 Am, and thereafter inserting said piston (8) into the packaging with said toric sealing joint (9) in contact with said internal side wall (17).

* * * * *